US006007364A

United States Patent [19]

Wu

[11] Patent Number: 6,007,364

[45] Date of Patent: Dec. 28, 1999

[54] GUIDE POST ASSEMBLY

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/342,660

[22] Filed: Jun. 28, 1999

[30] Foreign Application Priority Data

Sep. 4, 1998 [TW] Taiwan ..... 87214664

[51] Int. Cl.[6] ..... H01R 13/648

[52] U.S. Cl. ..... 439/378; 439/101

[58] Field of Search ..... 439/378–381, 439/607, 101, 108, 825–828

[56] References Cited

U.S. PATENT DOCUMENTS 4,904,194 2/1990 Kilsdonk et al. ..... 439/101
5,356,300 10/1994 Costello et al. ..... 439/378
5,449,304 9/1995 Huss, Jr. et al. ..... 439/825

FOREIGN PATENT DOCUMENTS 2632127 12/1989 France ..... 439/378

*Primary Examiner*—Gary F. Paumen
*Attorney, Agent, or Firm*—Wei Te Chung

[57] ABSTRACT

A guide post assembly comprises a body member and a retaining member attached to the body member. The body has a coupling portion for engaging with a first connector and a cylindrical guiding portion for engaging with a second connector. The retaining member is stamped and rolled from a thin sheet of metal material to form a spring ferrule and a resilient expanded portion extending from the ferrule. The expanded portion forms a bulge projecting outwardly from a middle position thereof which resiliently abuts against an inner wall of a housing of the second connector to retain the guiding portion of the body member in the second connector. Thus, the first and second connectors are securely connected by the guide post assembly.

4 Claims, 4 Drawing Sheets

GUIDE POST ASSEMBLY

BACKGROUND OF THE INVENTION

The present invention relates to a guide post assembly of an electrical connector.

U.S. Pat. No. 5,474,472 and Taiwan Patent Application No. 82203331 disclose connectors having guide posts. The guide posts disclosed consist of poles. When the poles on one connector and corresponding holes on a mating connector are not accurately manufactured, the two connectors may not properly mate together. Hence, an improved electrical connector is required to overcome the disadvantages of the prior art.

BRIEF SUMMARY OF THE INVENTION

An object of the present invention is to provide a guide post assembly for guiding the mating of a first connector to a second connector smoothly, accurately and quickly.

Accordingly, a guide post assembly comprises a body member and a retaining member attached to the body member. The body has a coupling portion for engaging with a first connector and a cylindrical guiding portion for engaging with a second connector. The retaining member is stamped and rolled from a thin sheet of metal material to form a spring ferrule and a resilient expanded portion extending from the ferrule. The expanded portion forms a bulge projecting outwardly from a middle position thereof which resiliently abuts against an inner wall of a housing of the second connector to retain the guiding portion of the body member in the second connector. Thus, the first and second connectors are securely connected by the guide post assembly.

Other objects, advantages and novel features of the invention will become more apparent from the following detailed description of the present embodiment when taken in conjunction with the accompanying drawings.

BRIEF DESCRIPTION OF THE DRAWINGS

FIG. 3 is a perspective view of the guide post assembly and a first connector that the guide post assembly is attached to.

DETAILED DESCRIPTION OF THE INVENTION

Figure 3:
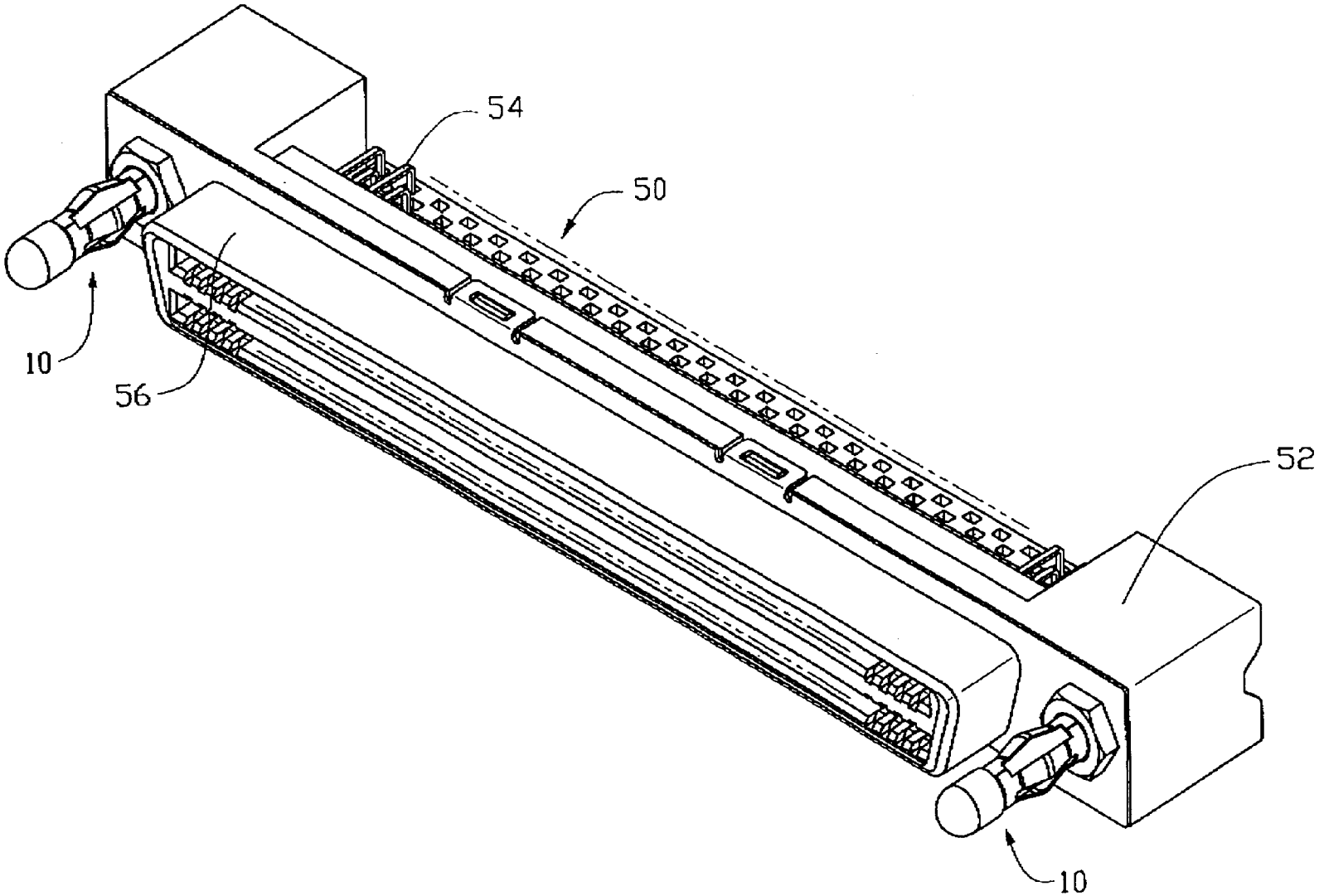
Figure 4:
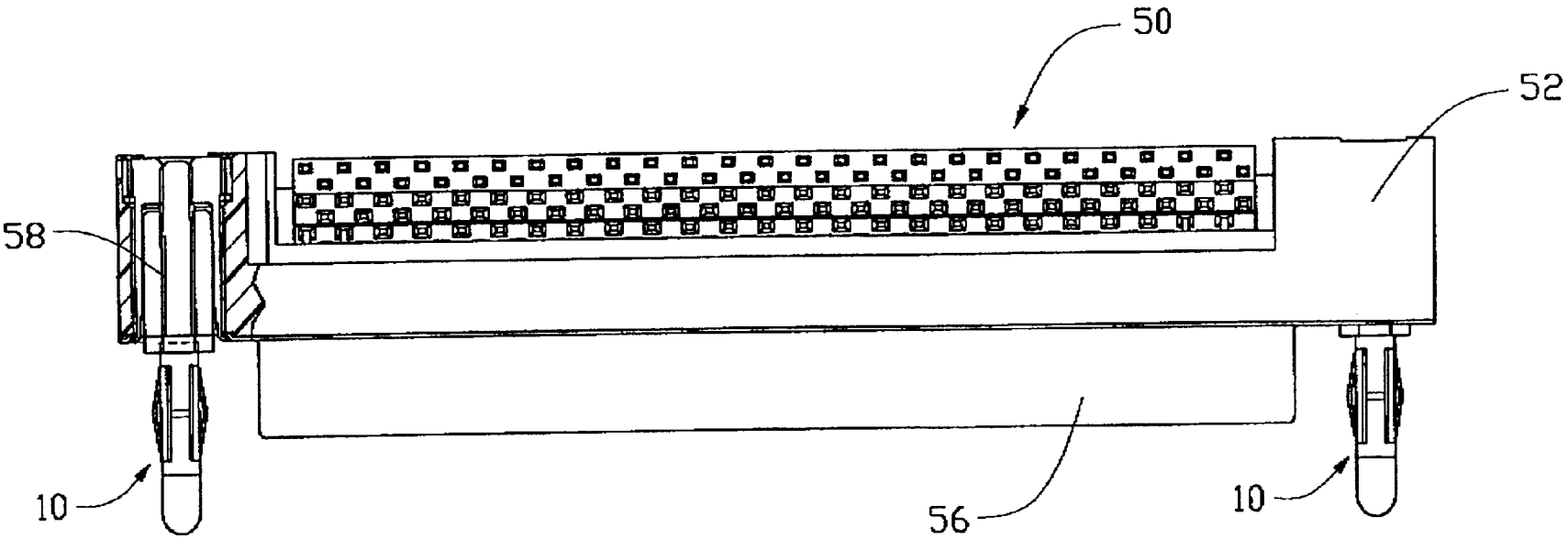
FIG. 4 is a top-view of FIG. 3 exposing an interior of an end portion of the first connector.

A guide post assembly 10 of the present invention is used for guiding and retaining first and second connectors which transfer electrical signals therebetween. Referring to FIGS. 3 and 4, the first connector 50 comprises an elongate dielectric housing 52, a plurality of conductive contacts 54 received in the housing 52 and a shield 56 covering a front portion of the housing 52. The housing 52 defines a pair of threaded channels 58 in opposite ends thereof for receiving the guide post assembly 10 therein.

Figure 1:
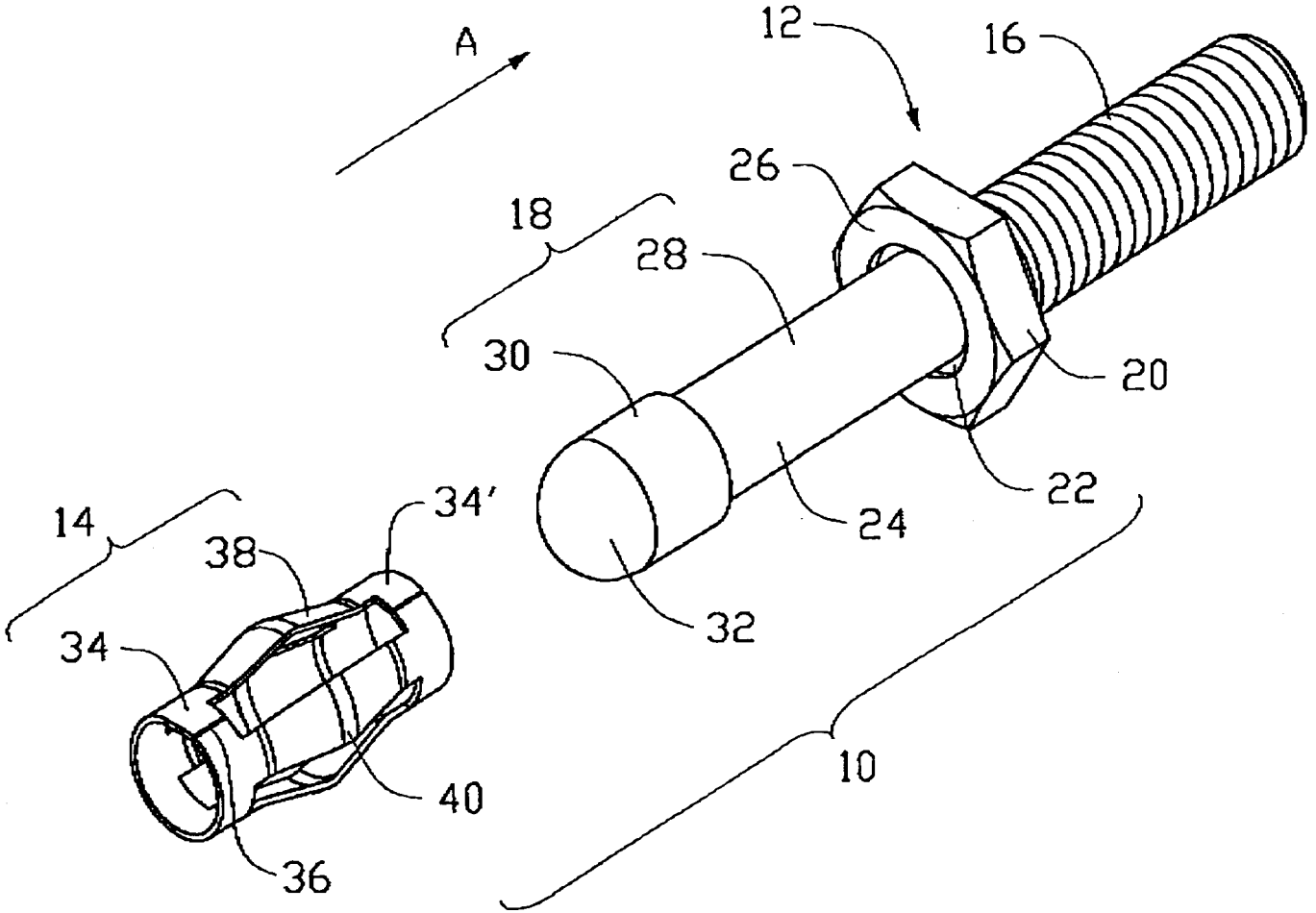
FIG. 1 is an exposed perspective view of a guide post assembly of the present invention.

Referring to FIG. 1, the guide post assembly 10 comprises a body member 12 and a retaining member 14 for attaching to the body member 12. The body member 12 has a coupling portion 16 which forms a thread thereon for retaining the guide post assembly 10 in the first connector 50 (FIG. 4) and a cylindrical guiding portion 18 extending from one end of the coupling portion 16 for guiding the second connector (not shown) to mate with the first connector 50. The coupling portion 16 engages with the first connector 50 but the guiding portion 18 extends beyond the first connector 50 and engages with the second connector.

A hexagonal section 20 is formed between the coupling portion 16 and the guiding portion 18. An annular channel 22 is defined in a side face 26 of the hexagonal section 20 proximate the guiding portion 18. The guiding portion 18 comprises a pole 28 and a head 30 extending from a free end of the pole 28. The head 30 has a rounded free end 32. The diameter of the head 30 is larger than the diameter of the pole 28.

The retaining member 14 is stamped and formed from a thin sheet of metal material to form a pair of spring ferrules 34, 34' each having a seam 36 and a resilient expanded portion 38 connecting the ferrules 34, 34' at opposite ends thereof. The expanded portion 38 forms a bulge 40 projecting outwardly from a middle position thereof. The expanded portion 38 is designed to be a plurality of fingers equidistantly spaced from each other for obtaining a significantly flexible characteristic in a preferred embodiment of the guide post assembly of the present invention.

Figure 2:
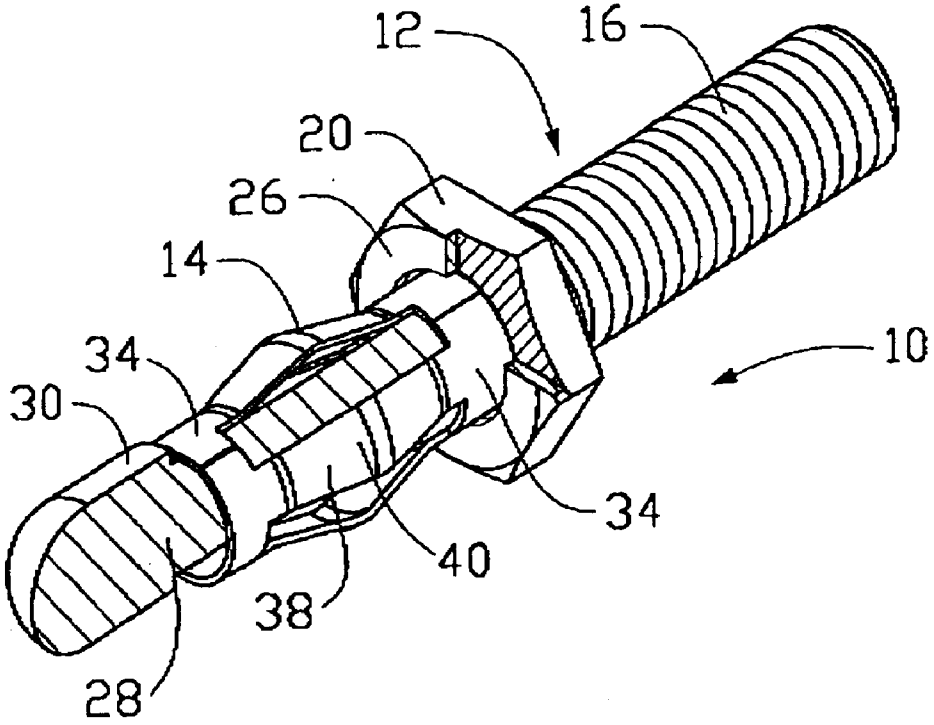
FIG. 2 is a perspective view of a guide post assembly of the present invention.

Also referring to FIG. 2, in assembly, the retaining member 14 is assembled to the body member 12 in the direction indicated by arrow A shown in FIG. 1 with the ferrule 34 (34') together with the expanded section 38 in slidable contact with an outer surface 24 of the pole 28. When the guide post assembly 10 is received in a aperture of a housing of the second connector, an inner face of the aperture flattens the expanded portion 38 of the retaining member 14 until an end of the retaining member 14 abuts against a side face of the head 30 and an opposite end of the retaining member 14 is received in the annular channel 22 of the hexagonal section 20. Thus, a retaining force is produced between the guide post assembly 10 and the second connector to securely join them together. It is understood that the bulge 40 defines a contour dimension which is larger than that of the head 30 so that the head 30 with the round free end 32 and the associated pole 28 guides mating with a complementary connector while the inward deflectable bulge 40 provides retention thereof.

A second embodiment of the guide post assembly of the present invention is described as follows but is not shown in the drawing. The second embodiment is similar to the first embodiment except that the second embodiment only has one spring ferrule connecting an end of the expanded portion, and the expanded portion is correspondingly longer than that of the first embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A guide post assembly for guiding and joining first and second mating electrical connectors together, the guide post assembly comprising:

a body member having a coupling portion at one end thereof received in the first connector and a cylindrical guiding portion at the other end thereof extending beyond the first connector for guiding the second connector to mate with the first connector; and a retaining member having at least one spring ferrule with a seam and a resilient outwardly expanded portion, the ferrule being attached about the cylindrical guiding portion of the body member, the expanded portion being adapted to engage the second connector;

wherein a hexagonal section is formed between the coupling portion and the cylindrical guiding portion;

wherein the cylindrical guiding portion comprises a pole and a head at a free end of the pole, the diameter of the head being larger than the diameter of the pole; and wherein an annular channel is defined in a side face of the hexagonal section around the pole of the cylindrical guiding portion.

2. The guide post assembly as claimed in claim 1, wherein the expanded portion comprises a plurality of spring fingers each forming an outwardly projecting bulge.

3. The guide post assembly as claimed in claim 1, wherein the retaining member comprises one spring ferrule formed at an end thereof proximal to the coupling portion of the body member.

4. An electrical connector comprising:

an insulative housing with a plurality of contacts therein and a shielding covering thereon;

a guide post assembly including:

a body member with a coupling portion at one end attached to the housing of the connector and also grounded to the shielding, and a guiding portion at the other end for guidably mating a complementary connector with the connector; and a retaining member formed on the guiding portion with a plurality of inwardly radially deflectable spring fingers thereon so that the guide post assembly functions to guide, retain and ground.

* * * * *